United States Patent [19]

Minks

[11] Patent Number: 4,554,522

[45] Date of Patent: Nov. 19, 1985

[54] ELECTROMAGNETIC RELAY

[75] Inventor: Werner Minks, Heroldsberg-Kleingeschaidt, Fed. Rep. of Germany

[73] Assignee: International Standard Electric Corporation, New York, N.Y.

[21] Appl. No.: 541,716

[22] Filed: Oct. 13, 1983

[30] Foreign Application Priority Data

Oct. 22, 1982 [DE] Fed. Rep. of Germany ..... 3239047

[51] Int. Cl.[4] ..... H01H 45/02

[52] U.S. Cl. ..... 335/202; 335/106; 174/525

[58] Field of Search ..... 335/106, 154, 202; 174/528 E, 525; 361/331, 356, 357, 394, 417, 419

[56] References Cited

U.S. PATENT DOCUMENTS 4,312,116 1/1982 Moser et al. ..... 174/525

*Primary Examiner*—John C. Martin
*Assistant Examiner*—George Andrews
*Attorney, Agent, or Firm*—James B. Raden; William J. Michals

[57] ABSTRACT

In a relay according to this invention the terminal elements (17) are injection-molded into wall members (2,3) which are so designed that they during assembly, and if so required, together with parts of the flange (35) of the coil (16) of the electromagnetic driving system, form a cup-shaped member having a bottom part (4). The rim portion (9) of the cover member (1) which is capable of being placed thereon, projects over the bottom part (4). The thus resulting space may be filled with a sealing compound (casting resin) (13). From this there results a tight relay consisting of a few individual parts only, which is easy to manufacture and which, moreover, is solder- and wash-tight.

11 Claims, 8 Drawing Figures

ELECTROMAGNETIC RELAY

The present invention relates to an electromagnetic relay of the type as set forth in the preamble of claim 1.

It is known with such types of relays to insert the driving system together with the terminal elements from above into a cup, and to lead the terminal elements through corresponding boreholes provided for in the bottom of the cup.

The cup is then closed with a cover. Such types of relays, however, are not tight, in particular not washtight. Therefore, in the course of soldering the terminal elements, e.g. into a printed circuit board, it can easily happen that soldering flux enters into the interior. Moreover, such a relay often also does not meet the requirements placed on the washtightness.

In order to obtain a solder-and wash-tight relay it is already known from DE-OS No. 3,036,301 to cover the inside bottom part of the cup with a fleece extending up to the side walls, and to arrange a foil thereon.

For permitting the passage of the terminal elements, corresponding passage holes have to be provided for in both the fleece and the foil, through which the terminal elements are either pushed or pressed.

Moreover, from DE-OS No. 2,622,133 it is known to cover the bottom of a cup-shaped lower portion of the housing with a sealing compound (casting resin) and to dip a cup-shaped cover member with its lower rim portion into the sealing compound when being inserted.

It is the object of the present invention to find a solution to the problem of designing a relay in such a way that it becomes manufacturable in a simple way and that both the contact system and the coil system can be manufactured and tested as individual component parts and that the relay, in addition thereto, can be made washtight or can be easily made washtight supplementarily.

This object is achieved by the features set forth in the characterizing part of claim 1.

From DE-OS No. 2,934,558 it is already known with respect to a relay comprising terminals molded into lateral walls to provide at the bottom within the area of the exit points of the terminals, a connecting groove and to fill this groove with a sealing compound. In that case, however, there is provided for this purpose an additional cup shaped bottom member through which the terminals are led. In the solution according to the invention, such an additional bottom member is not required.

Figure 1:
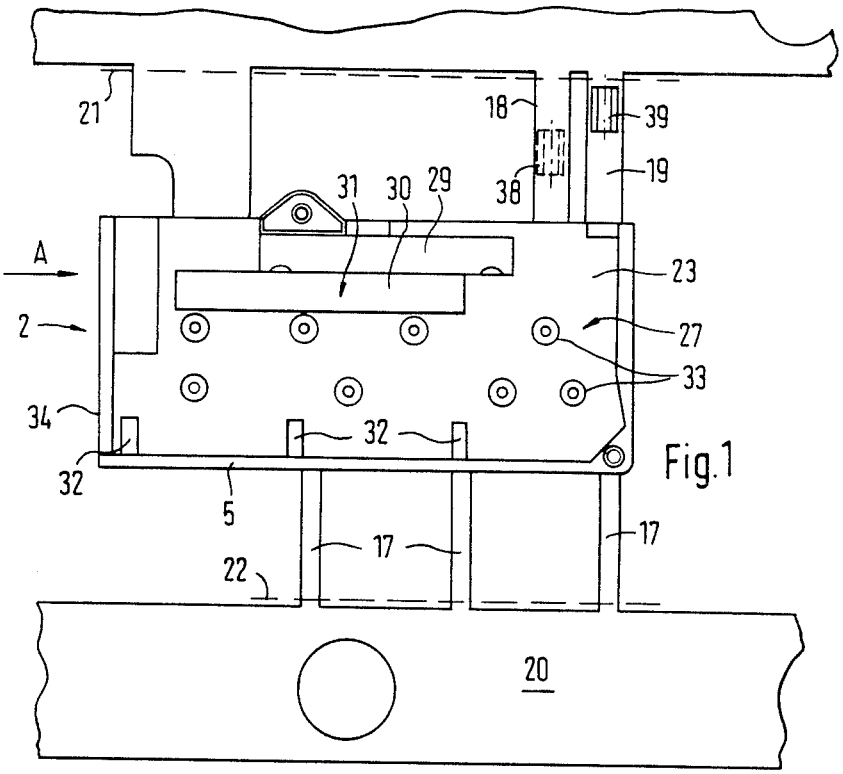
Figure 2:
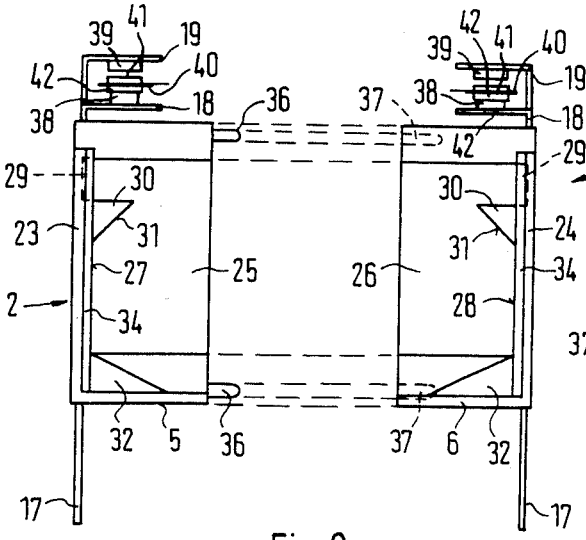
Figure 2A:
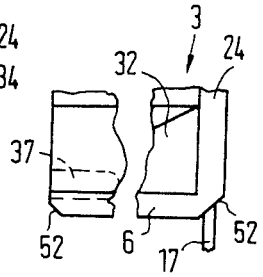
Figure 3:
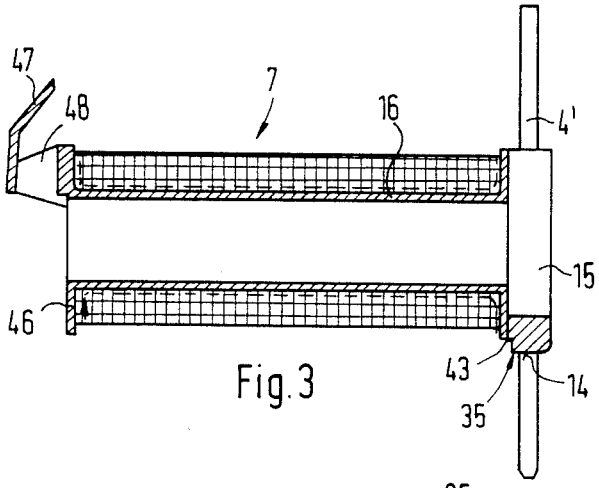
Figure 4:
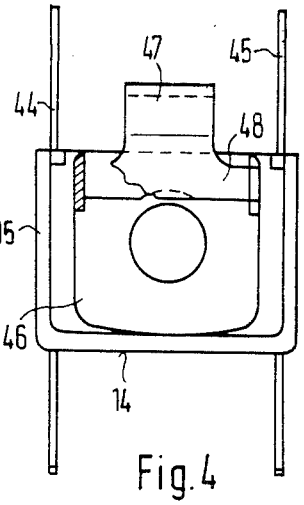
Figure 5:
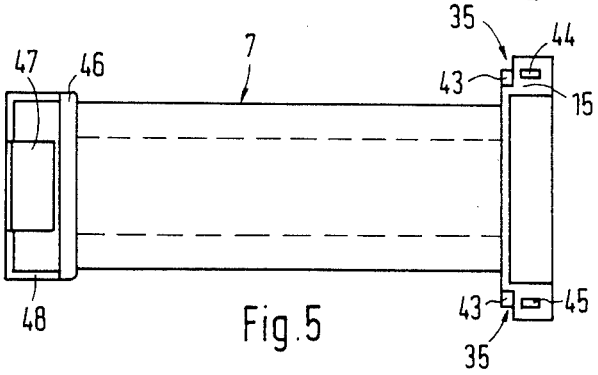
Figure 6:
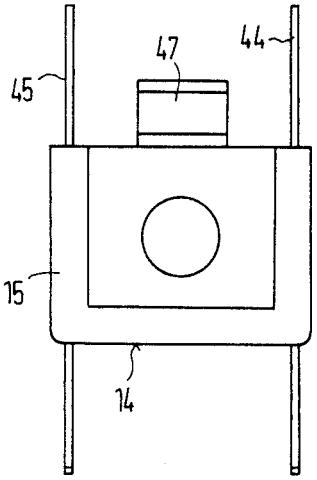
Figure 7:
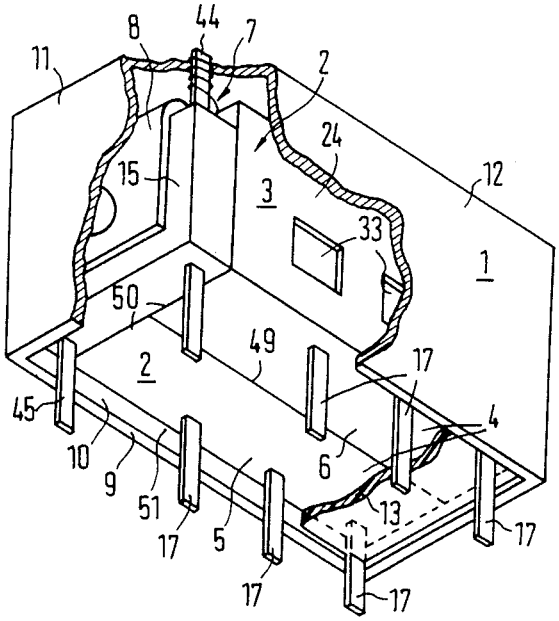

Further advantageous details of the invention are set forth in the subclaims and, in addition thereto, are described hereinafter with reference to an example of embodiment illustrated in FIGS. 1 to 7 of the accompanying drawings, in which FIG. 1 shows the inside of a housing member in the state not yet separated from a contact band, FIG. 2 is the front view in the direction as indicated by the arrow A in FIG. 1 onto two housing halves of the same type, with contact-band sections already bent over, FIG. 2*a* shows part of FIG. 2 on an enlarged scale, FIG. 3 shows a coilform according to the invention, in a sectional side view, FIG. 4 shows the one front view of the coilform of FIG. 3, FIG. 5 is a top view on to the coilform of FIG. 3, FIG. 6 shows the coilform of FIG. 3 as seen from the other front side, and FIG. 7 is a perspective view of the relay according to the invention as seen from below, partly sectionally.

The relay according to the invention, as shown in FIG. 7, consists of a cup-shaped cover member 1 into which two wall members 2, 3 each with a bottom member 5, 6 forming the bottom 4 are inserted. Within the wall members 2,3 there is accommodated the electromagnetic driving system consisting of the coil 7 (FIGS. 3 to 6), the yoke 8 and a not shown armature, as well as the contact spring assembly (FIGS. 1 and 2).

The rim portion 9 of the cover member 1 projects over the bottom 4, and the insides 10 of the front and side walls 11 and 12 of the cover member 1 surround the bottom 4 very tightly, that is, in the utmost with a very small airgap, so that into the thus formed lower space a sealing compound or casting resin 13 can be inserted which, prior to the hardening or curing is practically prevented from flowing towards the inside.

A portion of the bottom 4 is also still formed by a bottom member 14 of the one flange 15 of the coilform 16.

The casting or filling of the lower space with the sealing compound 13 can be carried out in the course of manufacturing the relay, or else relays according to the invention can be manufactured to be taken in stock and subsequently filled with the casting resin by the manufacture in accordance with customer requirements, or otherwise, the customer can perform the sealing with the sealing compound himself in accordance with requirements. Subsequently to the filling with the casting resin there is obtained a solder- and wash-tight relay which meets all relevant requirements.

A wall member 2 according to the invention is manufactured, for example, from a plastics material by employing the injection molding process, and in the course of this, the terminal elements 17 and the contact sections 18, 19 are molded in as well. The latter are attached to a contact band (tape) 20 from which the finished wall member 2 is cut off along the separating lines 21, 22 as indicated by the dashlines.

The wall member 2 and, if so required, a correspondingly designed mirror-inverted wall member 3 (FIG. 2), is provided with a side wall 23 or 24, a front wall member 25, 26 and a bottom member 5 or 6 respectively. On the inside 27 or 28 of the side walls 23, 24 there is each time provided a slot-shaped recess 29 serving as a fixing means which is capable of being engaged by a flap or tongue molded to the yoke member extending above the coil 7. In this way, the yoke can be fixed in its position during assembly.

Below the recess 29 there is provided a further fixing means in the form of a ledge having a bevelled surface 31. The latter serves as a manufacturing aid in the course of the fabricating and assembling process.

Lower ribs 32 serve the reinforcement or as supports for parts of the electromagnetic driving system.

On both the inside and the outside of the sidewall 23, 24 of the wall members 2, 3, round holes 33 are provided through which sheet metal parts of the contact tape 20 extending in the interior of the side wall 23 or 24, for the terminals 17 and the contact sections 18, 19 are visible and/or can be contacted with the aid of a probe tip.

On the side lying opposite the front wall members 25, 26, the side wall 23 or 24 and, if so required, also the bottom member 5 or 6 are each provided with a fold 34 in which a flange member 35 of the coil form 16 or a part thereof can be inserted and fixed.

Both side members 2, 3 are provided with means which are either capable of being plugged into one another and/or of engaging into one another, such as pins 36 and boreholes 37, with the aid of which there is effected a mutual fixing and, if so required, also a mounting in position of the side members 2, 3.

Between the contact sections 18, 19 with the fixed contacts 38, 39 there is provided, in the manner known per se, a movable contact arm 40 bearing both the upper and lower contacts 41, 42, which is actuated by the armature of the electromagnetic driving system.

Into the one coil flange 15 of the coil form 16 which, if so required, may be provided with an opposite fold 43 adapted to the fold 34 of the wall members 2, 3, the terminal pins 44, 45 are either inserted or molded. The other part thereof serves the mounting of the coil ends of the coil 7, and the lower part thereof serves as the actual terminating element, such as, for being soldered into the circuits, and are of a design similar to that of the terminal elements 17.

On the opposite flange 46 a resilient tongue 47 extending slantingly towards the inside and in the upward direction, is molded to a bracket 48, and serves for pressing the not shown tilting armature against a correspondingly designed yoke member and, consequently, for fixing the armature in position.

According to one advantageous embodiment of the invention, the lower edges of the bottom members 27, 28 and of the flange member 35, at the junction points 49, 50 between the bottom members 5, 6 themselves and between them and the flange member 35, as well as between the lines of contact 51 of the flange member 35 and the bottom members 5, 6 may either form with the inside 10 of the cover member 1 a slope 52 or have a corresponding fold (FIG. 2*a*).

During assembly there will result from this, at the junction points 49, 50 and the line of contact 51, a small groove in which the sealing compound 13 may flow. This permits the thickness of the sealing compound 13 to be reduced and yet to achieve a good sealing.

Moreover, thanks to the construction according to the invention, the readily assembled and contacted coil 16 and the assembled electromagnetic driving system can be separately subjected to the function tests with or without a contact actuation.

I claim:

1. Electromagnetic relay with terminal elements projecting therefrom and comprising:

a cup-shaped cover slidably and frictionally engaging with a pair of juxtaposed shells being self-aligned and self-locked relative to each other;

each shell having a plurality of said terminal elements being integral therewith and depending from one wall thereof;

said shells housing and complementary engaging an electromagnetic drive system so as to form continuous common bottom and side walls therewith;

terminal elements depending from both said system and said shells and projected outwardly from said common bottom wall;

said common bottom wall being offset from a rim of said cover;

a waterproof sealing compound filling the space in said offset and sealing all joints and seams of said bottom wall.

2. A relay as claimed in claim 1, and said drive system including a flange element abutting said shells so as to form said continuous walls.

3. A relay as claimed in claim 1, and said bottom wall having a T-shaped seam formed by said shells and said drive system.

4. A relay as claimed in claim 1, and said shells being self-aligning and self-locking by utilizing pins projecting from one shell into matching recesses in another shell.

5. A relay as claimed in claim 1, and said one wall of each shell being a side wall perforated by a plurality of openings facilitating an access to said terminal elements.

6. A relay as claimed in claim 1, and said drive system comprising a flange member abutting said shells and including parts matching corresponding counterparts in said shells;

said flange member being located at one end of said drive system.

7. A relay as claimed in claim 6, and said flange having a U-shaped configuration.

8. A relay as claimed in claim 1, and said shells comprising coupling means for securing said flange member thereto.

9. A relay as claimed in claim 1, and said shells comprising ribs supporting a coil means of said drive system.

10. A relay as claimed in claim 1, and said shells having locating means accommodating recesses and protrusions of elements of said drive system.

11. An electromagnetic relay structure comprising:

a cup-shaped cover slidably and frictionally engaging with a pair of juxtaposed shells being self-aligned and self-locked relative to each other;

each shell having a plurality of said terminal elements being integral therewith and depending from one wall thereof;

said shells housing and complementary engaging an electromagnetic drive system so as to form continuous common bottom and side walls therewith;

terminal elements depending from both said system and said shells and projected outwardly from said common bottom wall;

said common bottom wall being offset from a rim of said cover;

a sealing compound filling said offset space so as to provide a waterproof sealing layer inside said cover;

said drive system including a flange element abutting said shells so as to form said continuous walls;

said one wall of each shell being a side wall perforated by a plurality of openings facilitating an access to said terminal elements;

said shells comprising coupling means for securing said flange member thereto;

said flange supporting and rigidly attached to a coil body of said drive system.

* * * * *